US008479547B2

(12) United States Patent
Kataya et al.

(10) Patent No.: US 8,479,547 B2
(45) Date of Patent: Jul. 9, 2013

(54) VEHICLE PORTABLE DEVICE

(71) Applicants: Norihisa Kataya, Aichi (JP); Takayuki Suzuki, Aichi (JP); Akihiro Fujimoto, Aichi (JP); Hirofumi Ohata, Aichi (JP)

(72) Inventors: Norihisa Kataya, Aichi (JP); Takayuki Suzuki, Aichi (JP); Akihiro Fujimoto, Aichi (JP); Hirofumi Ohata, Aichi (JP)

(73) Assignee: Omron Automotive Electronics Co., Ltd., Aichi (JP)

( * ) Notice: Subject to any disclaimer, the term of this patent is extended or adjusted under 35 U.S.C. 154(b) by 0 days.

(21) Appl. No.: 13/707,844

(22) Filed: Dec. 7, 2012

(65) Prior Publication Data

US 2013/0145803 A1 Jun. 13, 2013

(30) Foreign Application Priority Data

Dec. 7, 2011 (JP) ..... 2011-267567

(51) Int. Cl.
*A44B 15/00* (2006.01)

(52) U.S. Cl.
USPC ..... 70/456 R; 70/252; 70/408; 24/3.6; 206/37.3; 340/5.64

(58) Field of Classification Search
USPC ... 70/252, 408, 456 R, 459; 24/3.6; 206/37.3, 206/37.8; 340/5.64, 5.65
See application file for complete search history.

(56) References Cited

U.S. PATENT DOCUMENTS 1,599,920 A * 9/1926 Pryor ..... 224/163
1,885,957 A * 11/1932 Singleton ..... 70/456 R
2,226,969 A * 12/1940 Onofrio ..... 24/3.5
2,694,244 A * 11/1954 Nolan ..... 24/650
3,579,750 A * 5/1971 Carbon et al. ..... 24/650
5,561,331 A * 10/1996 Suyama et al. ..... 307/10.3
6,216,501 B1 * 4/2001 Marquardt et al. ..... 70/252
6,382,003 B1 * 5/2002 Watanuki et al. ..... 70/252
6,460,386 B1 * 10/2002 Watanuki et al. ..... 70/456 R
6,672,118 B1 * 1/2004 Wright ..... 70/459
6,691,539 B2 * 2/2004 Jacob et al. ..... 70/408
7,098,791 B2 * 8/2006 Okada ..... 340/568.1
7,290,419 B2 * 11/2007 Balko et al. ..... 70/456 R (Continued)

FOREIGN PATENT DOCUMENTS

JP 2005213932 A 8/2005
JP 2007009555 A 1/2007
JP 2007032123 A 2/2007

OTHER PUBLICATIONS

Patent Abstracts of Japan, Publication No. 2007-032123, Dated: Feb. 8, 2007 (1 Page).

(Continued)

*Primary Examiner* — Suzanne Barrett
(74) *Attorney, Agent, or Firm* — Osha Liang LLP

(57) ABSTRACT

A vehicle portable device that locks and unlocks a door of a vehicle by remote control has a case that accommodates a mechanical key operable to lock and unlock the door of the vehicle therein, and having an accommodation part in which the mechanical key is inserted in a predetermined insertion direction, a first engagement part that engages with a second engagement part of the mechanical key, and a retaining member in which the first engagement part is formed. The retaining member is supported in the case while being rotatable about a first support point. An external force is provided on the retaining member so as to rotate the retaining member in a first rotating direction. When the mechanical key is accommodated in the accommodation part, an exposed portion of the mechanical key is partially exposed from the case.

20 Claims, 5 Drawing Sheets

U.S. PATENT DOCUMENTS

| | | | | |
|---|---|---|---|---|
| 7,448,238 | B2 | 11/2008 | Shimura et al. | |
| 7,513,134 | B2 * | 4/2009 | Hashimoto et al. | 70/456 R |
| 7,596,977 | B2 * | 10/2009 | Eychenne et al. | 70/257 |
| 7,634,932 | B2 * | 12/2009 | Cadiz et al. | 70/456 R |
| 7,690,233 | B2 * | 4/2010 | Katagiri et al. | 70/456 R |
| 7,726,161 | B2 * | 6/2010 | Canard et al. | 70/456 R |
| 7,897,888 | B2 * | 3/2011 | Dimig | 200/302.2 |
| 8,061,170 | B2 * | 11/2011 | Calor et al. | 70/459 |
| 8,359,891 | B2 * | 1/2013 | Fujimoto | 70/459 |
| 2004/0237613 | A1 * | 12/2004 | Shimura et al. | 70/456 R |
| 2005/0166650 | A1 | 8/2005 | Shimura et al. | |
| 2006/0260370 | A1 * | 11/2006 | Miwa et al. | 70/456 R |
| 2007/0137271 | A1 | 6/2007 | Katagiri et al. | |
| 2007/0223152 | A1 * | 9/2007 | Murakami et al. | 361/1 |
| 2008/0229794 | A1 | 9/2008 | Fujimoto | |
| 2010/0102927 | A1 * | 4/2010 | Monig | 340/5.64 |
| 2012/0092128 | A1 * | 4/2012 | Yamane et al. | 340/5.64 |

OTHER PUBLICATIONS

Patent Abstracts of Japan, Puiblication No. 2007-009555, Dated: Jan. 8,18, 2007 (1 Page).

* cited by examiner

VEHICLE PORTABLE DEVICE

TECHNICAL FIELD

The present invention relates to a vehicle portable device, particularly to a vehicle portable device of an electronic key system.

RELATED ART

In recent years an electronic key system becomes widespread. In the electronic key system, wireless communication is conducted between a portable device possessed by a user and a vehicle, and a door of the vehicle can be locked or unlocked when the portable device is successfully authenticated. In many of the portable devices of the electronic key systems, a mechanical key (or an emergency key) can be accommodated to mechanically lock and unlock the door of the vehicle when remote control cannot be performed due to runout of battery and the like.

Conventionally, the mechanical key is retained while detachably attached to the portable device. There is proposed a method for preventing the mechanical key from slipping out of the portable device or for easily taking off the mechanical key from the portable device.

For example, in a proposal disclosed in Japanese Unexamined Patent Publication No. 2007-9555, in order to prevent the mechanical key from slipping out of an insertion hole of the portable device, a projection is provided in the mechanical key to abut on an inner wall of the insertion hole, or a projection is provided in the mechanical key to be fitted in a recess of the insertion hole. Japanese Unexamined Patent Publication No. 2007-9555 also proposes that, in order that frictional force can prevent the mechanical key from slipping out of the portable device, a surface of the mechanical key is roughened, or a frictional member having a large friction coefficient is attached to the mechanical key.

For example, Japanese Unexamined Patent Publication No. 2005-213932 proposes that the mechanical key is prevented from unnecessarily slipping out of the portable device by pushing the mechanical key accommodated in the portable device using a slide type or see-saw type retaining mechanism.

For example, Japanese Unexamined Patent Publication No. 2007-32123 proposes that, while the mechanical key is accommodated in the portable device, an engagement member of a takeoff operating mechanism is engaged to a recess of the mechanical key to prevent the mechanical key from unnecessarily slipping out of the portable device, and a grasp part of the mechanical key projects from the case of the portable device to pull out the mechanical key when the engagement member is pressed and rotated by a coin and the like.

However, in the method disclosed in Japanese Unexamined Patent Publication No. 2007-9555, for example, in the case where a strong shock is exerted on the portable device due to a fall of the portable device and the like, because a direction in which the mechanical key flies out of the insertion hole by the shock agrees with a direction in which the mechanical key moves while the mechanical key is taken off from the portable device, it is assumed that the mechanical key may slip out of the portable device.

In the method disclosed in Japanese Unexamined Patent Publication No. 2005-213932, it is necessary to operate the retaining mechanism in order to take off the mechanical key from the portable device. Therefore, the mechanical key cannot easily be taken off from the portable device by operating only the mechanical key.

In the method disclosed in Japanese Unexamined Patent Publication No. 2007-32123, similarly to the method disclosed in Japanese Unexamined Patent Publication No. 2005-213932, it is necessary to operate the takeoff operating mechanism using the coin and the like in order to take off the mechanical key from the portable device, but the mechanical key cannot easily be taken off from the portable device by operating only the mechanical key.

SUMMARY

One or more embodiments of the present invention allows the mechanical key in use to be easily taken off while preventing the mechanical key from unnecessarily slipping out of the vehicle portable device.

According to one or more embodiments of the present invention, a vehicle portable device that is used to lock and unlock a door of a vehicle by remote control, the vehicle portable device includes: a case that can accommodate a mechanical key therein, the mechanical key for mechanically locking and unlocking the door of the vehicle, the case including an accommodation part in which the mechanical key is inserted in a predetermined insertion direction; and a retaining member in which an engagement part to be engaged to an engagement part of the mechanical key is formed, the retaining member being supported in the case while being rotatable about a first support point, an external force being provided on the retaining member so as to rotate the retaining member in a first rotating direction, wherein, while the mechanical key is accommodated in the accommodation part, the mechanical key is partially exposed from the case, the engagement part of the retaining member is engaged to the engagement part of the mechanical key to prevent the mechanical key from moving in a takeoff direction opposite to the insertion direction, and, when a force is exerted on a portion exposed from the case of the mechanical key in the takeoff direction, the mechanical key rotates about a second support point to disengage the engagement part of the retaining member from the engagement part of the mechanical key.

In a vehicle portable device according to one or more embodiments of the present invention, the mechanical key is prevented from moving in the takeoff direction opposite to the insertion direction while the mechanical key is accommodated in the accommodation part, and the mechanical key rotates about the second support point to disengage the engagement part of the retaining member from the engagement part of the mechanical key when the force is exerted on the portion exposed from the case of the mechanical key in the takeoff direction.

Accordingly, the mechanical key can easily be taken off in use while the mechanical key is prevented from unnecessarily slipping out of the vehicle portable device.

In a vehicle portable device according to one or more embodiments of the present invention, while the mechanical key is accommodated in the accommodation part, the retaining member may press down the mechanical key in a direction substantially perpendicular to the insertion direction by the external force.

Therefore, a position in the direction perpendicular to the insertion direction of the mechanical key is stabilized.

In a vehicle portable device according to one or more embodiments of the present invention, the engagement part of the mechanical key may press down the engagement part of the retaining member to rotate the retaining member in the second rotating direction opposite to the first rotating direction when the mechanical key is being inserted in the accommodation part in the insertion direction, and the retaining member may rotate in the first rotating direction by the external force to engage the engagement part of the retaining member with the engagement part of the mechanical key when the engagement part of the mechanical key reaches the portion of the accommodation part, which is deeper than the engagement part of the retaining member.

Therefore, the mechanical key can easily be accommodated in the vehicle portable device.

In a vehicle portable device according to one or more embodiments of the present invention, the mechanical key may have the substantial L-shape including the long-side portion and the short-side portion, and the leading end of the short-side portion may be exposed from the case while the mechanical key is accommodated in the accommodation part.

Therefore, the mechanical key can more easily be taken off from the vehicle portable device.

In a vehicle portable device according to one or more embodiments of the present invention, the guide groove may be provided around the portion of the case, in which the mechanical key is exposed, in order to exert the force on the exposed portion in the takeoff direction.

Therefore, the retaining mechanism of the mechanical key can be prevented from being destroyed due to the false operation.

In a vehicle portable device according to one or more embodiments of the present invention, the external force may be provided by a tension of a spring.

Therefore, the external force can be provided to the mechanical key by the simple configuration.

According to one or more embodiments of the present invention, the mechanical key is easily taken off in use while the mechanical key is prevented from unnecessarily slipping out of the vehicle portable device.

DETAILED DESCRIPTION

Embodiments of the present invention will be described below. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. The description is made as follows.

1. Embodiments
2. Modifications

1. Embodiments

Configuration Examples of Portable Device 1

Figure 1:
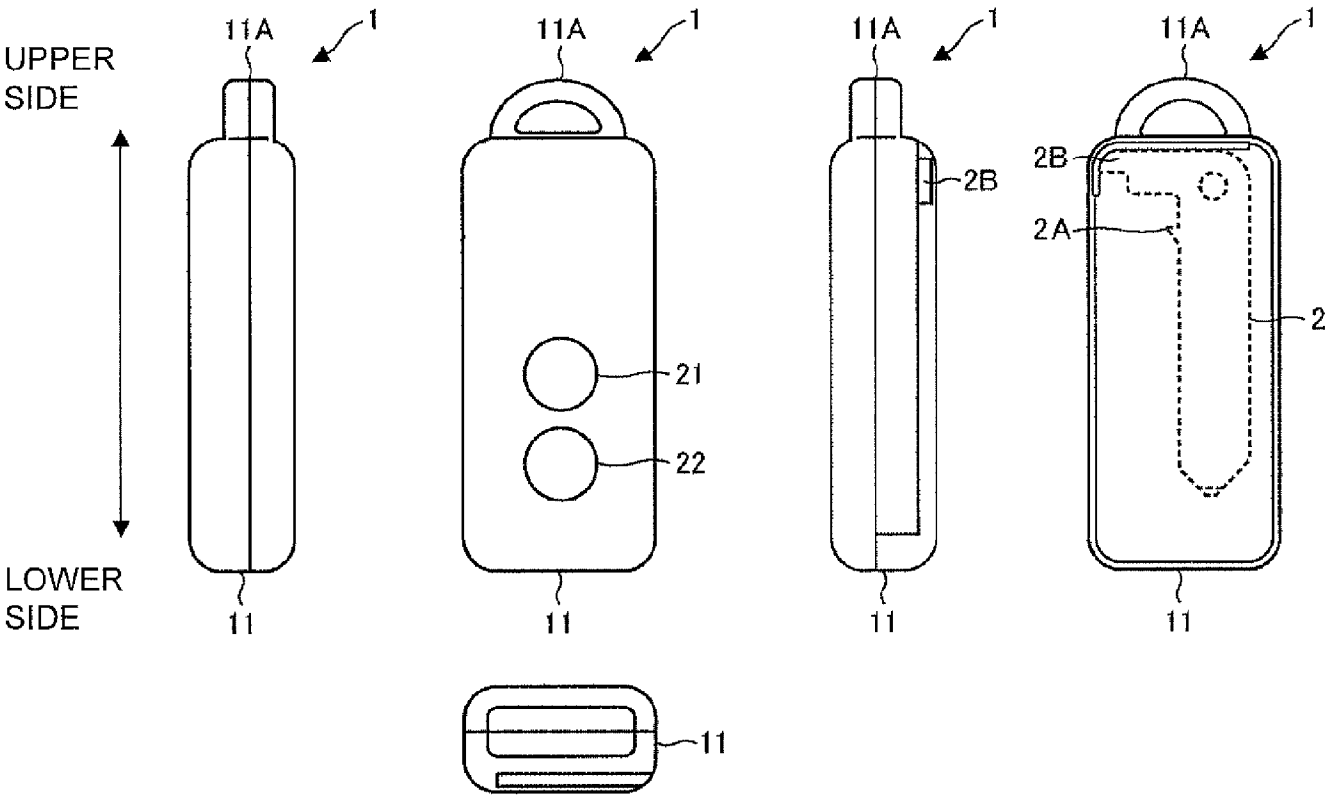
FIG. 1 is a front view, a rear view, a right side view, a left side view, and a bottom view of a portable device according to one or more embodiments of the invention.
Figure 2:
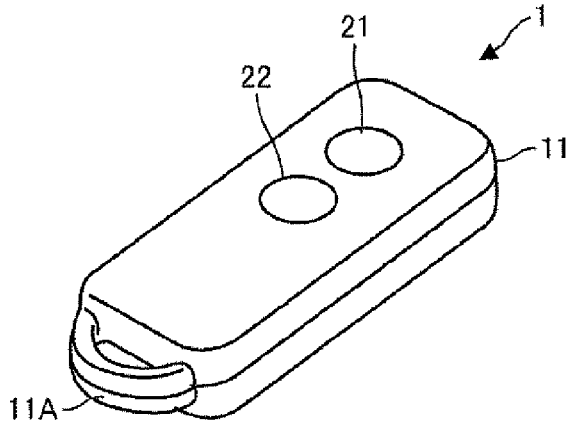
FIG. 2 is a perspective view illustrating a front surface of the portable device.
Figure 3:
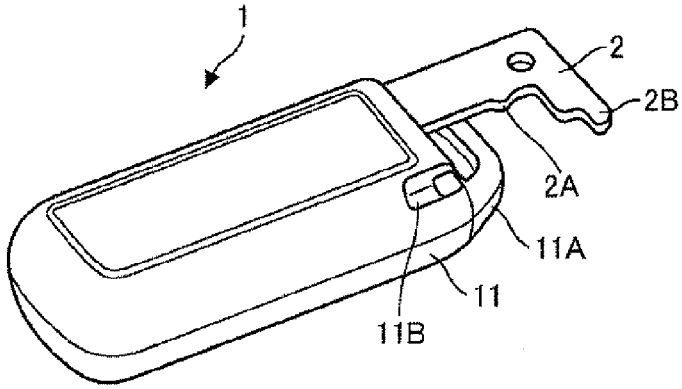
FIG. 3 is a perspective view illustrating a rear surface of the portable device when a mechanical key is being inserted in the portable device.
Figure 4:
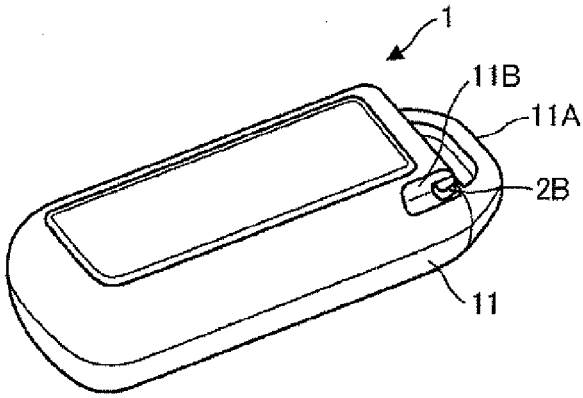
FIG. 4 is a perspective view illustrating the rear surface of the portable device when the mechanical key is accommodated in the portable device.
Figure 5:
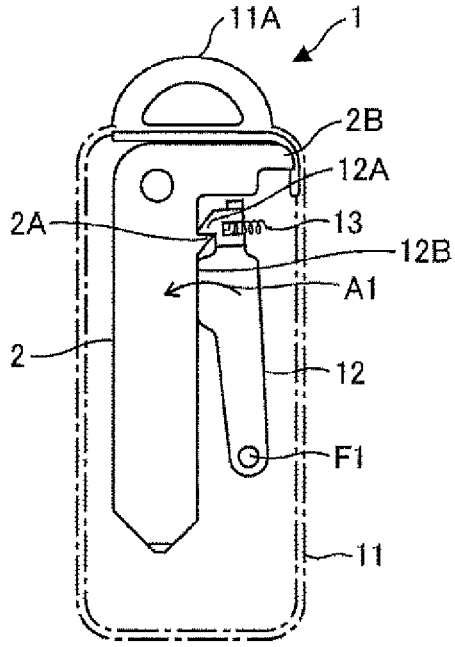
FIG. 5 is a transparent view illustrating the rear surface of the portable device when the mechanical key is accommodated in the portable device.

FIGS. 1 to 5 illustrates a portable device 1 according to one or more embodiments of the present invention. FIG. 1 shows a front view, a rear view, a right side view, a left side view, and a bottom view of the portable device 1. The rear view on a right end in FIG. 1 illustrates a position where a mechanical key 2 is accommodated in the portable device 1. FIG. 2 is a perspective view illustrating a front surface of the portable device 1. FIG. 3 is a perspective view illustrating a rear surface of the portable device 1 when the mechanical key 2 is inserting in the portable device 1. FIG. 4 is a perspective view illustrating the rear surface of the portable device 1 when the mechanical key 2 is accommodated in the portable device 1. FIG. 5 is a transparent view illustrating the rear surface of the portable device 1 when the mechanical key 2 is accommodated in the portable device 1.

The portable device 1 is used in an electronic key system that locks and unlocks a door of a vehicle (not illustrated) by remote control.

A case 11 of the portable device 1 has a rectangular-solid shape in which a corner is rounded, and a handle 11A is provided in one end portion in a lengthwise direction of the case 11. Hereinafter, as illustrated in FIG. 1, a side on which the handle 11A is provided is referred to as an upper side of the portable device 1, and the opposite side is referred to as a lower side of the portable device 1.

A button 21 and a button 22 are provided on a front surface of the case 11, and operated when the door of the vehicle is locked or unlocked by the remote control. A guide groove 11B that will be described later is provided on a right upper end portion of a rear surface of the case 11. The case 11 includes an accommodation part in which the mechanical key 2 can be accommodated. The mechanical key 2 mechanically locks and unlocks the door when the remote control cannot be performed due to runout of battery and the like.

The mechanical key 2 has a substantial L-shape including a long-side portion and a short-side portion. Hereinafter, in the lengthwise direction of the long-side portion of the mechanical key 2, a side on which the short-side portion is provided is referred to as an upper side of the mechanical key 2, and the opposite side (the side on which the key is inserted) is referred to as a lower side of the mechanical key 2. In a side surface (a thinner surface) of the long-side portion of the mechanical key 2, a surface in which the short-side portion extends is referred to as an inside surface, and a surface on the opposite side is referred to as an outside surface.

A projected engagement part 2A having a substantially right-triangle shape is formed in an upper portion in the inside surface of the long-side portion of the mechanical key 2 while an upper end of the engagement part 2A is substantially perpendicular to the long-side portion. An operating part 2B is formed at a leading end of the short-side portion of the mechanical key 2 by cutting a lower-side portion.

As illustrated in FIG. 3, the mechanical key 2 is accommodated in the case 11 such that the lower side of the long-side portion is inserted in the lengthwise direction of the long-side portion from the top surface of the case 11 of the portable device 1. As illustrated in FIG. 4, the operating part 2B is exposed to the outside from the guide groove 11B of the case 11 while the mechanical key 2 is accommodated in the case 11. A user gets user's finger caught in the operating part 2B exposed from the case 11 according to the guide groove 11B, and applies a force to the mechanical key 2 in an opposite direction (hereinafter referred to as a takeoff direction) to the insertion direction, thereby taking off the mechanical key 2 from the case 11.

As illustrated in FIG. 5, a retaining member 12 is supported in the case 11 while being rotatable about a support point F1. A projected engagement part 12A is formed on the side facing the mechanical key 2 in the leading end portion of the retaining member 12. The engagement part 12A has a shape symmetrical to the engagement part 2A. A spring 13 is attached on the opposite side to the side on which the engagement part 12A is formed in the leading end portion of the retaining member 12. The retaining member 12 and the spring 13 constitute a retaining mechanism that retains the mechanical key 2 in the case 11.

Specifically, while the mechanical key 2 is accommodated in the case 11, a side surface (hereinafter referred to as a lower side surface) on the lower side of the engagement part 12A of the retaining member 12 is engaged to a side surface (hereinafter referred to as an upper side surface) on the upper side of the engagement part 2A of the mechanical key 2. Therefore, a vertical position of the mechanical key 2 is fixed to prevent a movement of the mechanical key 2 in the takeoff direction. An external force is provided by a tension of the spring 13 so as to rotate the retaining member 12 in a direction of an arrow A1, an abutment surface 12B of the retaining member 12 abuts on the inside surface of the mechanical key 2, and the retaining member 12 presses down the mechanical key 2 in the direction substantially perpendicular to the insertion direction. Therefore, a horizontal position of the mechanical key 2 is fixed.

(Movement in the Case where Mechanical Key 2 is Inserted in Portable Device 1)

The movements of the mechanical key 2 and the retaining member 12 in the case where the mechanical key 2 is inserted in the case 11 of the portable device 1 will be described with reference to FIG. 6.

Figure 6A:
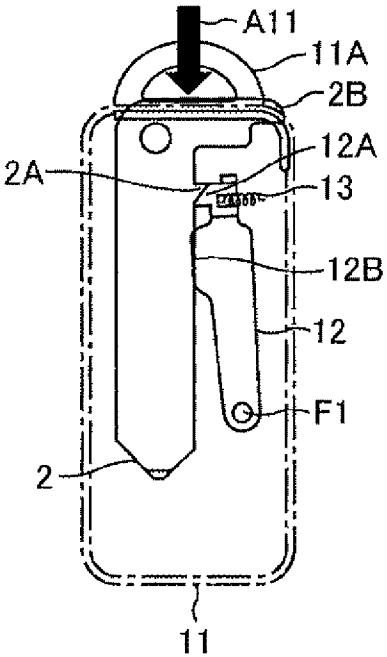
FIGS. 6A to 6C are views illustrating a movement in the case where the mechanical key is being inserted in the portable device.

When the mechanical key 2 is inserted in the case 11 in the insertion direction indicated by an arrow A11, a sloping surface of the engagement part 2A of the mechanical key 2 and a sloping surface of the engagement part 12A of the retaining member 12 abut on each other as illustrated in FIG. 6.

Figure 6B:
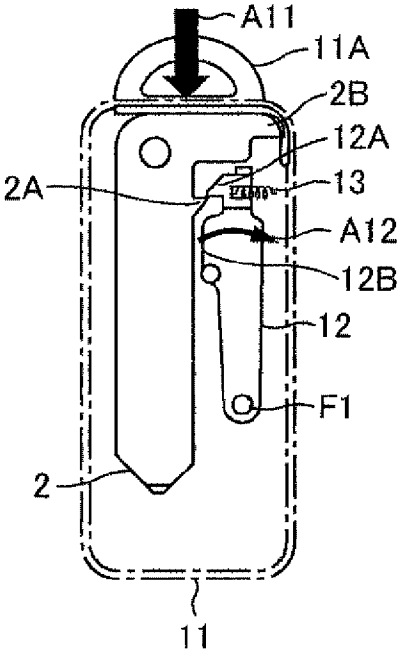

When the mechanical key 2 is further pressed in the direction of the arrow A11, as illustrated in FIG. 6B, the sloping surface of the engagement part 12A of the retaining member 12 is pushed by the sloping surface of the engagement part 2A of the mechanical key 2, whereby the retaining member 12 rotates about the support point F1 in the opposite direction to the rotating direction by the tension of the spring 13, namely, a direction (a direction indicated by an arrow A12) in which the retaining member 12 is separated from the mechanical key 2.

Figure 6C:
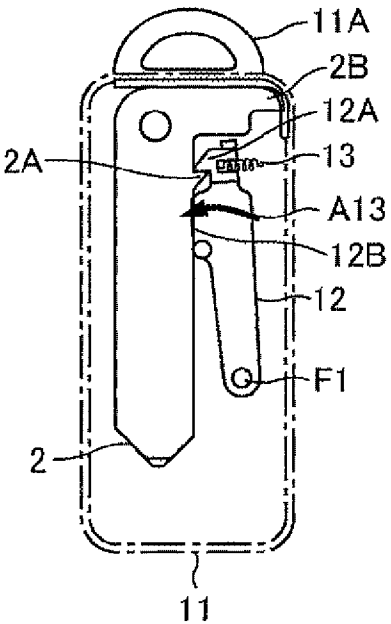

As illustrated in FIG. 6C, the engagement part 2A of the mechanical key 2 reaches a portion of the accommodation part of the case 11, which is deeper than the engagement part 12A of the retaining member 12, and the contact between the sloping surface of the engagement part 2A and the sloping surface of the engagement part 12A is released. At this point, the retaining member 12 rotates about the support point F3 by the tension of the spring 13 in a direction indicated by an arrow A13 in which the retaining member 12 abuts on and presses down the mechanical key 2. As a result, as described above with reference to FIG. 5, the mechanical key 2 is fixed in the case 11 by the retaining member 12.

(Movement in the Case where Mechanical Key 2 is Taken Off from Portable Device 1)

The movements of the mechanical key 2 and the retaining member 12 in the case where the mechanical key 2 is taken off from the case 11 of the portable device 1 will be described with reference to FIG. 7.

Figure 7A:
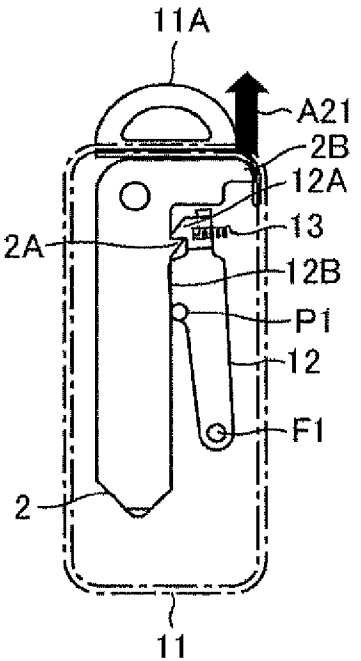
FIGS. 7A to 7D are views illustrating a movement in the case where the mechanical key is being taken off from the portable device.
Figure 7B:
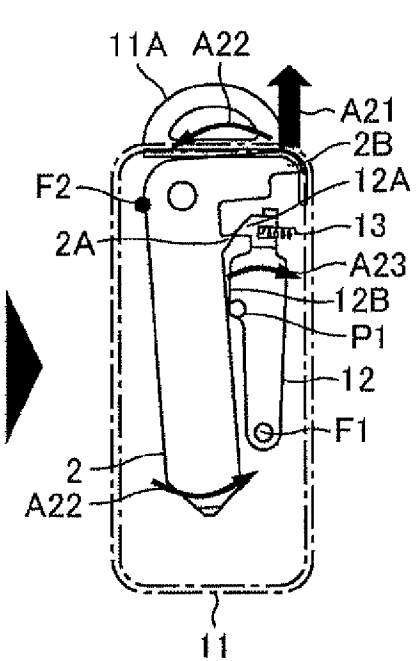

When taking off the mechanical key 2 from the case 11, the user gets user's finger caught in the operating part 2B of the mechanical key 2, which is exposed from the guide groove 11B of the case 11, and applies the force according to the guide groove 11B in a direction (a direction indicated by an arrow 21) in which the mechanical key 2 is taken off from the case 11. At this point, because the upper side surface of the engagement part 2A of the mechanical key 2 is caught in the lower side surface of the engagement part 12A of the retaining member 12, the mechanical key 2 does not move in the takeoff direction, but rotates about a support point F2 in a direction indicated by an arrow A22 as illustrated in FIG. 7B. On the other hand, in the retaining member 12, only an abutment point P1 (strictly, a side at a lower end of the abutment surface 12B) at the lower end of the abutment surface 12B abuts on the mechanical key 2, and the abutment point P1 is pushed by the mechanical key 2 to rotate about the support point F1 in a direction (direction indicated by an arrow A23) in which the abutment point P1 is separated from the mechanical key 2. At this point, a rotating axis of the mechanical key 2 and a rotating axis of the retaining member 12 are parallel to each other.

Figure 7C:
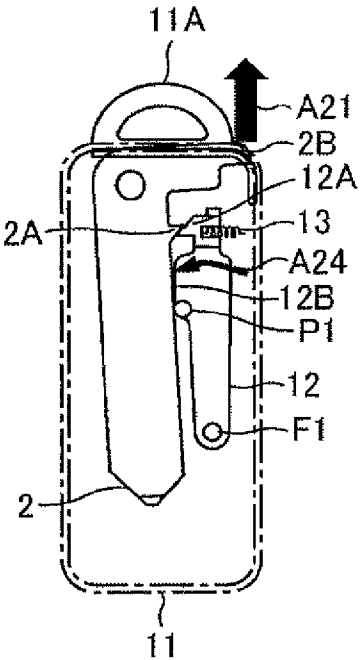
Figure 7D:
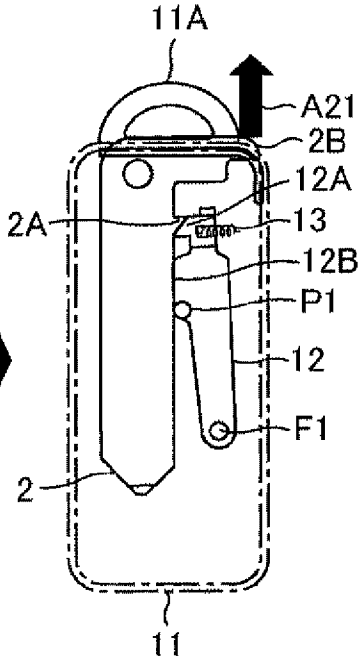

When the engagement part 2A of the mechanical key 2 and the engagement part 12A of the retaining member 12 are disengaged (when the contact between the upper side surface of the engagement part 2A and the lower side surface of the engagement part 12A is released), the retaining member 12 rotates in a direction indicated by an arrow A24 by the tension of the spring 13 to return to an original state as illustrated in FIG. 7C. Therefore, the inside surface of the mechanical key 2 is pushed by the abutment surface 12B of the retaining member 12 to fix the horizontal position of the mechanical key 2. Accordingly, the force is further exerted on the operating part 2B of the mechanical key 2 in the direction of the arrow A21, whereby the mechanical key 2 moves in the takeoff direction (the direction of the arrow A21) and is taken off from the case 11.

As described above, the user gets user's finger caught in the operating part 2B to exert the force in the direction of the arrow A21, which allows the user to easily take off the mechanical key 2 from the case 11 of the portable device 1.

In the case where the mechanical key 2 is taken off, it is necessary to rotate the mechanical key 2 in the direction of the arrow A22 in FIG. 7B in order to disengage the engagement part 2A of the mechanical key 2 from the engagement part 12A of the retaining member 12. In the case where a strong shock is exerted on the portable device 1 due to a drop of the portable device 1, the rotating direction indicated by the arrow A22 differs from the direction (direction of the arrow A21) in which the mechanical key 2 flies out of the case 11 of the portable device 1 by the shock. Accordingly, even if the strong shock is exerted on the portable device 1 due to the drop of the portable device 1, the mechanical key 2 is prevented from slipping out of the portable device 1.

Additionally, the operating part 2B of the mechanical key 2 is exposed from the guide groove 11B of the case 11, which allows the user to be prevented from taking off the mechanical key 2 by an unusual method. As a result, the retaining mechanism including the retaining member 12 and the spring 13 can be prevented from being destroyed due to the false operation.

Additionally, it is not necessary that the retaining mechanism that retains the mechanical key 2 and the operating mechanism that takes off the mechanical key 2 be provided outside the case 11. Therefore, beauty or a degree of freedom of a configuration of an appearance is improved in the portable device 1.

2. Modifications

Modifications of embodiments of the present invention will be described below.

For example, using a method and a member except the spring 13, the external force may be provided so as to rotate the retaining member 12 in the direction of the arrow A1 (see FIG. 5).

For example, the rotating axis of the retaining member 12 is set to a direction (for example, a horizontal direction on a sheet surface in FIG. 5) perpendicular to the above embodiments, and the retaining member 12 may be rotated in the direction perpendicular to the above embodiments.

A notch (a recessed shape) is provided as the engagement part 2A in the inside surface of the long-side portion of the mechanical key 2, and the engagement part 12A of the retaining member 12 may be caught in the notch.

The present invention is not limited to the above embodiments, and various changes can be made without departing from the scope of the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicle portable device configured to lock and unlock a door of a vehicle by remote control, the vehicle portable device comprising:

a case configured to accommodate a mechanical key operable to lock and unlock the door of the vehicle therein, and comprising an accommodation part in which the mechanical key is inserted in a predetermined insertion direction;

a first engagement part configured to engage with a second engagement part of the mechanical key; and a retaining member in which the first engagement part is formed, wherein the retaining member is supported in the case while being rotatable about a first support point, wherein an external force is provided on the retaining member so as to rotate the retaining member in a first rotating direction, wherein, when the mechanical key is accommodated in the accommodation part, an exposed portion of the mechanical key is partially exposed from the case, and the first engagement part is engaged to the second engagement part to prevent the mechanical key from moving in a takeoff direction opposite to the insertion direction, and wherein, when a force is exerted on the exposed portion in the takeoff direction, the mechanical key rotates about a second support point to disengage the first engagement part from the second engagement part.

2. The vehicle portable device according to claim 1, wherein, when the mechanical key is accommodated in the accommodation part, the retaining member presses down the mechanical key in a direction substantially perpendicular to the insertion direction by the external force.

3. The vehicle portable device according to claim 2, wherein the second engagement part presses down the first engagement part to rotate the retaining member in a second rotating direction opposite to the first rotating direction when the mechanical key is being inserted in the accommodation part in the insertion direction, and the retaining member rotates in the first rotating direction by the external force to engage the first engagement part with the second engagement part when the second engagement part reaches a portion of the accommodation part, which is deeper than the first engagement part.

4. The vehicle portable device according to claim 1, wherein the mechanical key has a substantial L-shape including a long-side portion and a short-side portion, and a leading end of the short-side portion is exposed from the case while the mechanical key is accommodated in the accommodation part.

5. The vehicle portable device according to claim 1, wherein a guide groove is provided on the case around the exposed portion, in order to exert the force on the exposed portion in the takeoff direction.

6. The vehicle portable device according to claim 1, wherein the external force is provided by a tension of a spring.

7. The vehicle portable device according to claim 2, wherein the mechanical key has a substantial L-shape including a long-side portion and a short-side portion, and a leading end of the short-side portion is exposed from the case while the mechanical key is accommodated in the accommodation part.

8. The vehicle portable device according to claim 3, wherein the mechanical key has a substantial L-shape including a long-side portion and a short-side portion, and a leading end of the short-side portion is exposed from the case while the mechanical key is accommodated in the accommodation part.

9. The vehicle portable device according to claim 2, wherein a guide groove is provided on the case around the exposed portion, in order to exert the force on the exposed portion in the takeoff direction.

10. The vehicle portable device according to claim 3, wherein a guide groove is provided on the case around the exposed portion, in order to exert the force on the exposed portion in the takeoff direction.

11. The vehicle portable device according to claim 4, wherein a guide groove is provided on the case around the exposed portion, in order to exert the force on the exposed portion in the takeoff direction.

12. The vehicle portable device according to claim 7, wherein a guide groove is provided on the case around the exposed portion, in order to exert the force on the exposed portion in the takeoff direction.

13. The vehicle portable device according to claim 8, wherein a guide groove is provided on the case around the exposed portion, in order to exert the force on the exposed portion in the takeoff direction.

14. The vehicle portable device according to claim 2, wherein the external force is provided by a tension of a spring.

15. The vehicle portable device according to claim 3, wherein the external force is provided by a tension of a spring.

16. The vehicle portable device according to claim 4, wherein the external force is provided by a tension of a spring.

17. The vehicle portable device according to claim 5, wherein the external force is provided by a tension of a spring.

18. The vehicle portable device according to claim 7, wherein the external force is provided by a tension of a spring.

19. The vehicle portable device according to claim 8, wherein the external force is provided by a tension of a spring.

20. The vehicle portable device according to claim 9, wherein the external force is provided by a tension of a spring.

* * * * *